US009028381B2

(12) United States Patent
Mestemaker

(10) Patent No.: US 9,028,381 B2
(45) Date of Patent: May 12, 2015

(54) DOOR-MOUNTED FITNESS DEVICE WITH REMOVABLE PULLEY MEMBERS

(71) Applicant: Michael J. Mestemaker, Cincinnati, OH (US)

(72) Inventor: Michael J. Mestemaker, Cincinnati, OH (US)

( * ) Notice: Subject to any disclaimer, the term of this patent is extended or adjusted under 35 U.S.C. 154(b) by 157 days.

(21) Appl. No.: 13/652,805

(22) Filed: Oct. 16, 2012

(65) Prior Publication Data

US 2014/0106949 A1 Apr. 17, 2014

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 21/16*** | (2006.01) |

(52) U.S. Cl.

CPC ..... *A63B 21/00069* (2013.01); *A63B 21/04* (2013.01); *A63B 21/0414* (2013.01); *A63B 21/0555* (2013.01); *A63B 21/0557* (2013.01); *A63B 21/1469* (2013.01); *A63B 21/154* (2013.01); *A63B 21/1636* (2013.01); *A63B 2225/09* (2013.01); *A63B 2225/093* (2013.01); *A63B 21/00065* (2013.01)

(58) Field of Classification Search

CPC .... A63B 21/04; A63B 21/02; A63B 21/0407; A63B 21/0435; A63B 21/0442

USPC ..... 482/92, 121, 129–130

See application file for complete search history.

(56) References Cited

U.S. PATENT DOCUMENTS 232,579 A * 9/1880 Weeks ..... 482/129
760,374 A 5/1904 Belvoir
1,112,114 A 9/1914 Caines
2,959,414 A * 11/1960 Saltz ..... 482/127
689,418 A 9/1972 Ryan
3,726,537 A * 4/1973 McLoughlin ..... 280/47.26
3,814,084 A 6/1974 Gustafson
4,056,289 A * 11/1977 Gilliland ..... 305/47
4,072,308 A 2/1978 Applegate
4,109,907 A 8/1978 Zito
4,135,714 A * 1/1979 Hughes ..... 482/127
4,253,663 A * 3/1981 Hughes ..... 482/127

(Continued)

FOREIGN PATENT DOCUMENTS

CN 201612969 U 10/2010

OTHER PUBLICATIONS

Ultimate Muscle Explosion (Tower 200 Door Gym Product Literature), 2009 (16 pages).

(Continued)

*Primary Examiner* — Stephen Crow
*Assistant Examiner* — Garrett Atkinson
(74) *Attorney, Agent, or Firm* — Wood, Herron & Evans, LLP

(57) ABSTRACT

A fitness device for mounting on a door is useful for performing resistance exercises. The fitness device includes an upper member including a door anchor for securing the upper member to the door and a pulley support bracket having a pivot pin. The fitness device also includes a lower member including a door anchor for securing the lower member to the door and a pulley support bracket having a pivot pin. An elastic cord extends generally between the upper and lower members and is associated with two pulley members. The pulley members are configured to be removably received on the pivot pins. The pulley members include bores having keyways and the pivot pins include nubs configured to be received in the keyways.

12 Claims, 7 Drawing Sheets

(56) References Cited

U.S. PATENT DOCUMENTS

| | | | | |
|---|---|---|---|---|
| 4,293,127 | A * | 10/1981 | Dudley | 482/120 |
| 4,344,616 | A * | 8/1982 | Ogden | 482/54 |
| 4,402,504 | A | 9/1983 | Christian | |
| 4,521,013 | A | 6/1985 | Dofel | |
| 4,606,541 | A | 8/1986 | Kirkpatrick | |
| 4,619,453 | A | 10/1986 | Plumridge | |
| 4,662,629 | A | 5/1987 | Plovie | |
| 4,816,008 | A * | 3/1989 | Leonard | 474/47 |
| 4,988,096 | A * | 1/1991 | Jones | 482/94 |
| 5,145,197 | A * | 9/1992 | Gatti | 280/304.1 |
| 5,176,602 | A | 1/1993 | Roberts | |
| 5,221,240 | A | 6/1993 | Mann et al. | |
| 5,240,460 | A | 8/1993 | Tighe | |
| 5,468,205 | A * | 11/1995 | McFall et al. | 482/129 |
| 5,556,369 | A | 9/1996 | Roberts | |
| 5,571,064 | A | 11/1996 | Holm | |
| 5,601,518 | A | 2/1997 | Weintraub | |
| 763,475 | A | 6/1998 | Sato et al. | |
| 5,766,118 | A | 6/1998 | Conner | |
| 5,820,529 | A | 10/1998 | Weintraub | |
| 5,839,994 | A | 11/1998 | Elbogen | |
| 5,871,422 | A | 2/1999 | Elbogen | |
| 6,015,371 | A | 1/2000 | Davitt | |
| 6,059,698 | A | 5/2000 | Mazor | |
| 6,106,444 | A | 8/2000 | Maingart | |
| 6,113,564 | A | 9/2000 | McGuire | |
| 6,267,711 | B1 | 7/2001 | Hinds | |
| 6,301,978 | B1 * | 10/2001 | Sargent | 73/862.49 |
| 6,319,179 | B1 | 11/2001 | Hinds | |
| 6,322,483 | B1 | 11/2001 | Rotella | |
| 6,394,935 | B1 * | 5/2002 | Lake | 482/94 |
| 6,450,929 | B1 | 9/2002 | Markham | |
| 6,652,419 | B1 | 11/2003 | Rota | |
| 6,662,651 | B1 | 12/2003 | Roth | |
| 6,726,606 | B2 | 4/2004 | Jacobsen | |
| 6,908,418 | B2 | 6/2005 | Saure | |
| 6,929,589 | B1 * | 8/2005 | Bruggemann et al. | 482/138 |
| 7,137,936 | B1 * | 11/2006 | Shaw et al. | 482/127 |
| 7,534,197 | B1 | 5/2009 | Harbers, Jr. | |
| 7,651,448 | B2 | 1/2010 | Hetrick | |
| 7,819,784 | B1 | 10/2010 | Caswell et al. | |
| 7,871,359 | B2 * | 1/2011 | Humble et al. | 482/127 |
| 7,976,445 | B2 * | 7/2011 | Lalaoua | 482/129 |
| 8,033,960 | B1 * | 10/2011 | Dalebout et al. | 482/38 |
| D650,451 | S | 12/2011 | Olson et al. | |
| 8,079,942 | B2 | 12/2011 | Anderson | |
| 2002/0022555 | A1 | 2/2002 | Nesci | |
| 2002/0119869 | A1 | 8/2002 | Whited Lake | |
| 2003/0186792 | A1 | 10/2003 | Keeler | |
| 2004/0033866 | A1 | 2/2004 | Shapiro | |
| 2004/0087420 | A1 | 5/2004 | Montesquieux | |
| 2004/0097349 | A1 | 5/2004 | Rogers | |
| 2005/0003931 | A1 * | 1/2005 | Mills et al. | 482/5 |
| 2005/0113222 | A1 | 5/2005 | Dovner et al. | |
| 2005/0221964 | A1 | 10/2005 | Liester | |
| 2005/0227827 | A1 | 10/2005 | Liester | |
| 2006/0084556 | A1 | 4/2006 | Payne | |
| 2009/0075787 | A1 | 3/2009 | Hetrick | |
| 2010/0126902 | A1 | 5/2010 | Garza, Jr. et al. | |
| 2010/0173759 | A1 | 7/2010 | Lalaoua | |
| 2010/0267526 | A1 | 10/2010 | Baschnagel | |
| 2011/0177921 | A1 * | 7/2011 | Olson et al. | 482/92 |
| 2011/0195825 | A1 | 8/2011 | Liester | |
| 2011/0269608 | A1 | 11/2011 | Eubanks | |

OTHER PUBLICATIONS

Tower 200 Door Gym website: http://www.shopbodybyjake.com/index.php/tower-200, printed Jan. 18, 2013 (2 pages).

Weider X-Factor website: http://www/weiderfitness.com/webapp/wcs/stores/servlet/Category__-1__14801__17102__59001__Y, printed Jan. 18, 2013 (4 pages).

* cited by examiner

DOOR-MOUNTED FITNESS DEVICE WITH REMOVABLE PULLEY MEMBERS

TECHNICAL FIELD

The present invention generally relates to fitness equipment, and more particularly to door-mounted fitness equipment that uses resilient elastic cords to provide resistance exercises.

BACKGROUND

Exercising is a popular activity for maintaining fitness and promoting overall good health. Numerous options exist for exercising, such as jogging, hiking, cycling, weight training, racquetball, and many others. In the area of weight training, for example, free-standing bars, dumbbells, weight plates, and other heavy objects have long been used as part of exercise routines aimed at improving muscular strength and endurance. In addition, machines have been developed for providing weight training exercises. While some of these machines are large and costly, and are therefore usually found in fitness clubs, others are small and less expensive, and are generally more likely found in homes and offices. Thus, exercise equipment that can mount on a wall or on a door in a home or office provides an alternative to the larger and more costly machines.

In U.S. Pat. No. 232,579, which is an early example of wall-mounted fitness equipment, a partially elastic cord is passed around pulleys, which are mounted on a wall. A user grasps the cord and exerts his strength against the resistance provided by the elastic portion of the cord to perform exercises. The pulleys are mounted to the wall by a screw or hook, and therefore represent a permanent or semi-permanent installation on the wall.

U.S. Pat. No. 689,418 is also an early example of fitness equipment and discloses a door-mounted exercising machine that extends between the top and bottom of a door. The exercising machine uses a collection of elastic cords to provide resistance-based exercise. In particular, the collection of elastic cords is connected with a holder, and a cord passes through a pulley on the holder. The cord also passes through additional pulleys that are situated in an appropriate position on the door so that handles on the cord are presented for grasping by a user. A user grasps the cord by its handles and exerts his strength against the resistance provided by the collection of elastic cords to perform exercises.

U.S. Pat. No. 4,109,907 discloses another example of door-mounted fitness equipment. Pulleys are mounted to clips that extend over the top of a door, and a cord is passed over each pulley. A weight is attached at one end of each cord, and a handle at the other. A user grasps the handle of each cord and exerts his strength against the resistance provided by the weights to perform exercises.

Door-mounted fitness equipment has continued to develop from these early examples and the marketplace currently provides several popular products. For example, the "Tower 200" product sold by the Body By Jake company and the "Weider X-Factor" product sold by the Weider Fitness company are both door-mounted devices that use elastic cords and can be configured to provide a variety of exercise movements. For example, a user can grasp handles from several positions to perform exercises such as chest presses, shoulder presses, pull-downs, abdominal crunches, and many others. However, these particular devices come pre-assembled with elastic cords that provide a limited amount of resistance that some users may find insufficient, or in some cases, excessive.

Where insufficient resistance is provided, a user will not be able to achieve a maximal level of exertion and may not receive exercise commensurate with his abilities. Alternatively, the resistance provided by a particular device may be excessive. As a result, the user will not be able to use the device, and therefore will be deprived of its benefits. The construction of such devices may not allow for adjustment of the resistance. Thus, the user cannot easily replace or modify the elastic cords so as to be able to change the amount of resistance provided thereby.

Also, in these particular devices, the upper components that attach to the top of the door are pre-assembled and connected by the cords to the lower components that attach to the bottom of the door. As a result of this connected and pre-assembled configuration, the entire collection of upper components, lower components, and cords must be handled at the same time. In other words, a user cannot install the upper components onto a door without at the same time contending with the lower components and the cords, which can make installation, storage, and transportation of the devices somewhat cumbersome.

Thus, a need exists for improvements in the door-mounted fitness equipment technology area that address one or more of the shortcomings presented by the prior art.

SUMMARY

The present invention provides a fitness device that can be mounted on a door and a pulley member that allows for an elastic resistance cord used with the fitness device to be easily installed and removed therefrom. To that end, and in accordance with one feature of the present invention, a fitness device is provided for mounting on a door and being useful for performing resistance exercises. The fitness device includes an upper member including a door anchor for securing the upper member to the door, and a first pulley support bracket having a first pivot pin. The fitness device further includes a lower member including a door anchor for securing the lower member to the door, and a second pulley support bracket having a second pivot pin. The fitness device further includes an elastic cord configured to extend generally between the upper and lower members and being associated with first and second pulley members. The first pulley member is configured to be held selectively captive on the first pivot pin, and the second pulley member is configured to be held selectively captive on the second pivot pin.

In accordance with another feature of the present invention, a pulley member for use with a door-mountable fitness device is provided. In particular, the pulley member is for use with a door-mountable fitness device having a pulley support bracket having a pivot pin that includes nubs extending from an outer wall thereof. The pulley member includes a body having a mounting portion and a pulley portion. The mounting portion includes a bore configured to receive the pivot pin of the fitness device, and the bore includes keyways configured to receive the nubs of the pivot pin.

In accordance with yet another feature of the present invention, a method of manipulating a pulley member with respect to a pivot pin of a fitness device is provided. The method includes positioning a bore of the pulley member onto the pivot pin so the pulley member is held selectively captive on the pivot pin in a manner appropriate for using the fitness device.

By virtue of the foregoing, there is thus provided a fitness device, a pulley member therefor, and related methods, all having desirable qualities, but without the limitations of the prior art. Particularly, a fitness device and pulley members are provided, wherein the pulley members are easily installed on and removed from the fitness device. The pulley members being easily installed and removed allows a user to install and remove elastic cords on the fitness device, providing control over the selection of the elastic cords used with the fitness device. For example, a user can select and use elastic cords that provide a desired amount of resistance. These and other advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and together with the general description of the invention given above and the detailed description of the embodiments given below, serve to explain the principles of the present invention.

DETAILED DESCRIPTION OF THE DRAWINGS

Figure 1:
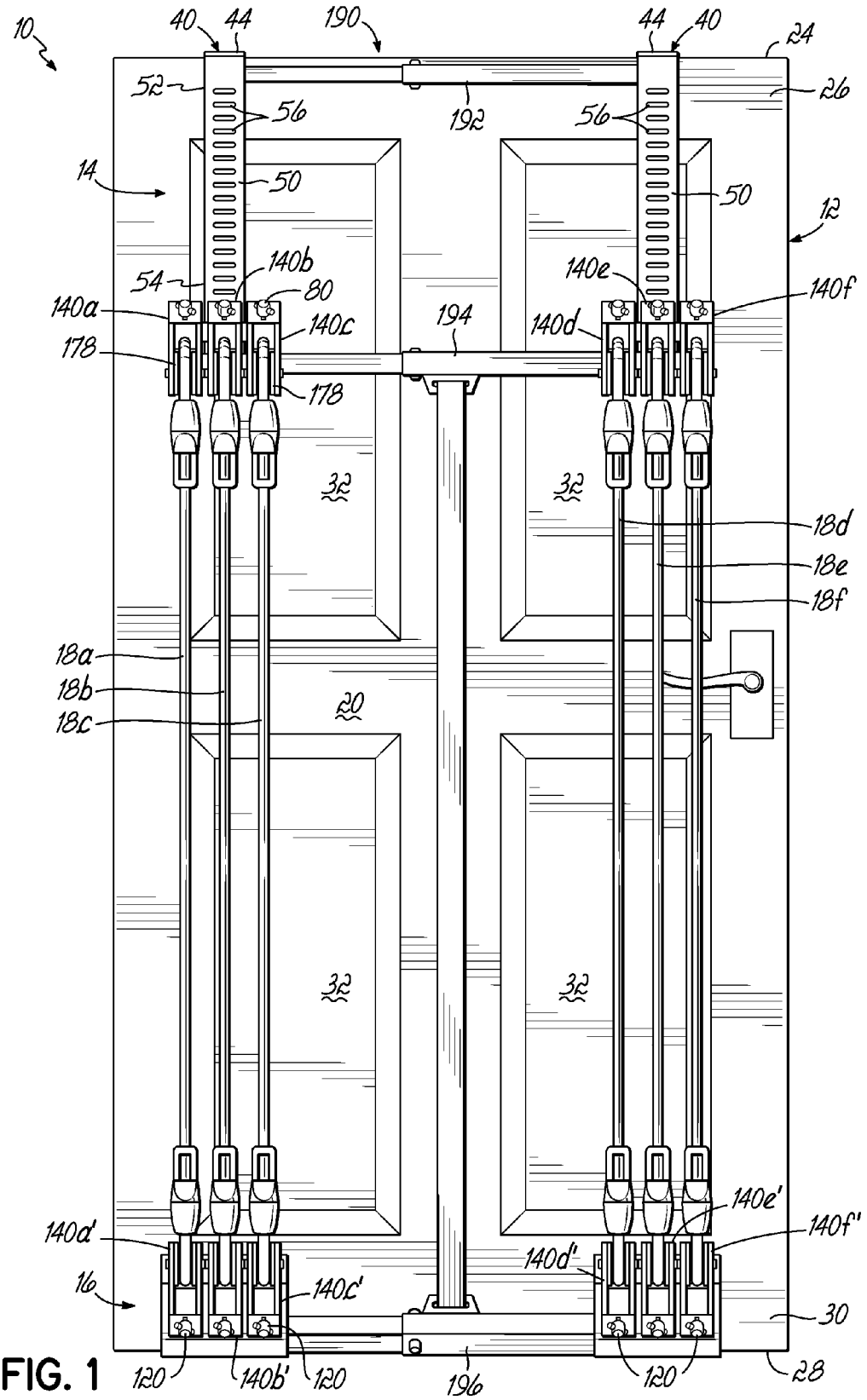
FIG. 1 is a front elevation view depicting a fitness device according to the present invention mounted on a door.

Referring now to the drawings and beginning with FIG. 1, a fitness device 10 is shown in the context of it being mounted on a door 12. The device 10 generally includes an upper member 14 and a lower member 16, and a plurality of resilient or elastic cords 18*a*-18*f*. The device 10 is useful for performing resistance exercises and provides several advantages over prior art forms, as will be appreciated from the following description. Elastic cords 18*a*-18*f* can have any suitable construction and can provide varying amounts of resistance for performing resistance exercises. For example, elastic cords 18*a* and 18*f* (outermost elastic cords 18) may provide heavy resistance, elastic cords 18*b* and 18*e* (middle elastic cords 18) may provide intermediate resistance, and elastic cords 18*c* and 18*d* (innermost elastic cords 18) may provide light resistance. It is understood that the location of the varying resistance elastic cords 18*a*-18*f* can be modified, as preferred. It is also understood that handles or straps (not shown) can be attached to the elastic cords in a manner known in the art so as to provide a user with a location to grip the elastic cords.

Figure 2A:
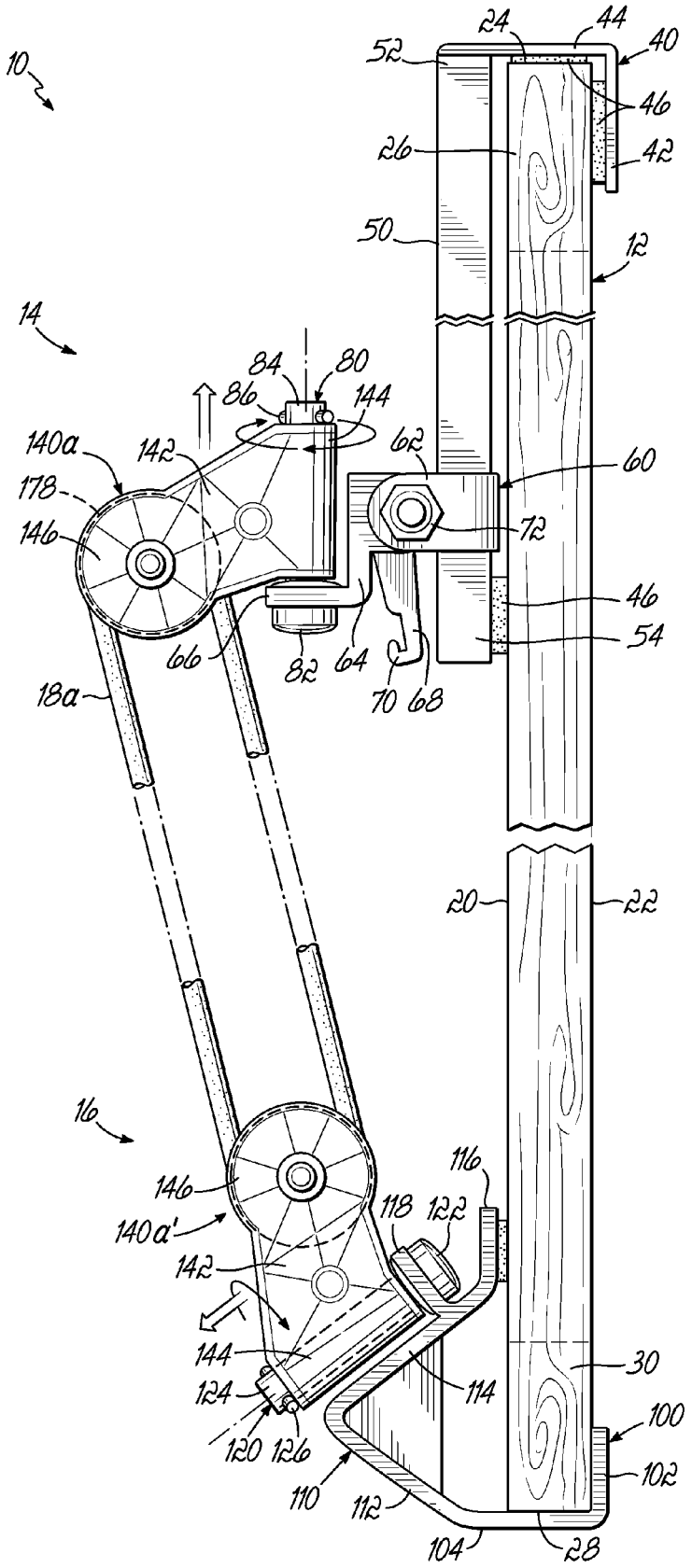
FIG. 2A is a side view depicting additional features of the door-mounted fitness device and the door shown in FIG. 1, including pulley members positioned on pivot pins of respective upper and lower members.
Figure 2B:
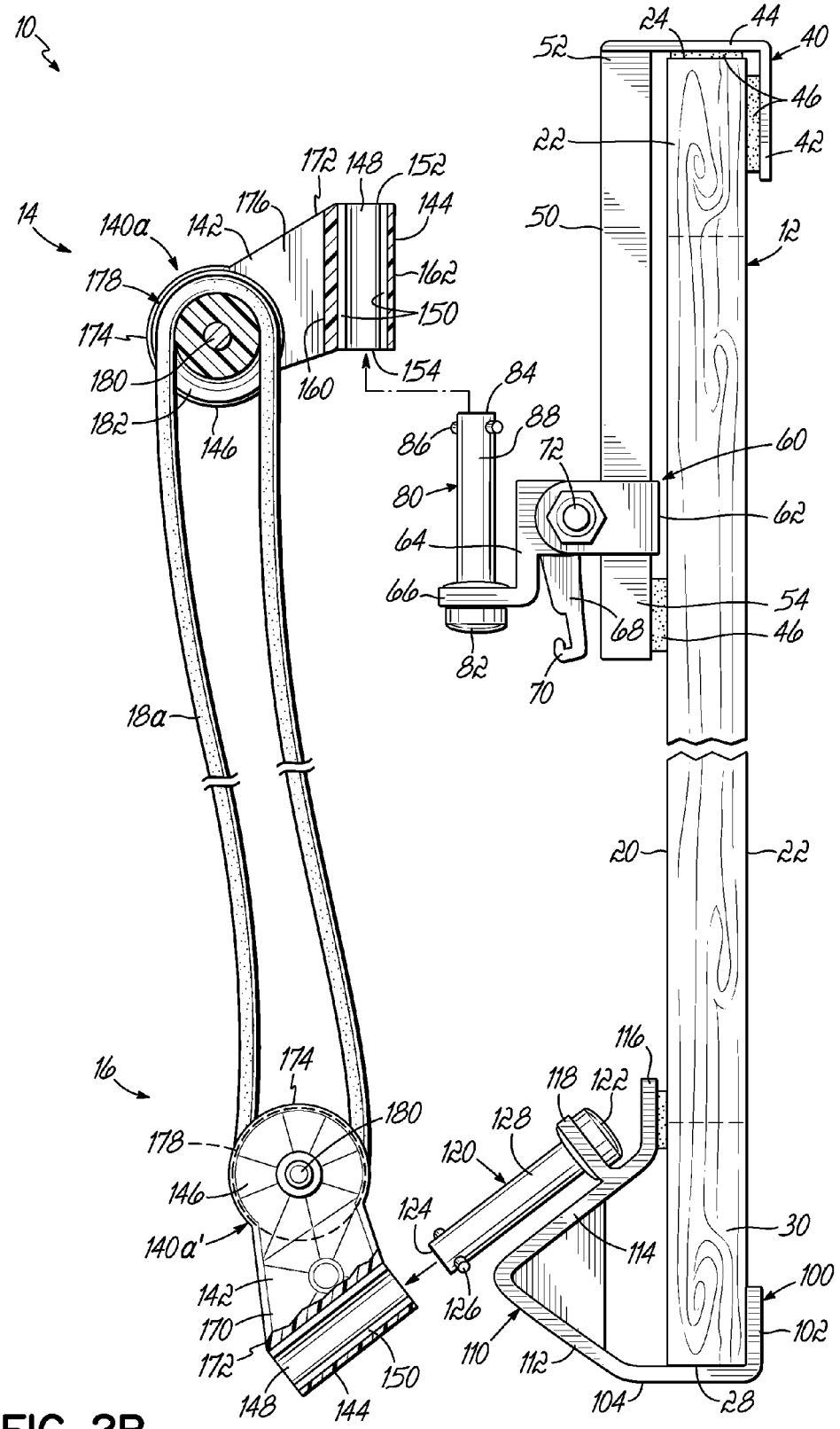
FIG. 2B is a view like in FIG. 2A but partially in cross section showing the pulley members removed from the pivot pins.

As shown in FIGS. 1, 2A, and 2B, the door 12 with which the device 10 is shown includes a front side 20, a back side 22, a top surface 24, a top rail portion 26 generally near the top surface 24, a bottom surface 28, and a bottom rail portion 30 generally near the bottom surface 28. The door 12 is merely exemplary however, and the device 10 can be used with several other types of doors or other sufficiently sturdy substantially vertical surfaces. For example, the door 12 includes panels 32, but the device 10 could also be used with a door having flat front and rear sides as well.

The upper member 14 of the device 10 includes two generally similar door anchors 40 for connecting with the door 12. In particular, each door anchor 40 includes a first, generally vertical, portion 42 and a second, generally horizontal, portion 44. The second portion 44 extends over the top surface 24 of the door 12, and the first portion 42 extends downwardly from the second portion 44 along the back side 22 of the door 12. Pads 46 can be included on the first and second portions 42, 44 so that the door anchor 40 does not damage the finish as it rests on the door 12. The second portion 44 extends beyond the front side 20 of the door 12, and an arm 50 of the upper member 14 depends downwardly from the second portion 44 generally near the front side 20 in the region of the top rail portion 26. The arm 50 extends between a proximal end 52 near the door anchor 40 and a distal end 54 away from the door anchor 40. Positioning slots 56 are included in the arm 50 between the proximal and distal ends 52, 54. A pad 46 can be included on the arm 50, such as near the distal end 54, as shown, so that the arm 40 does not damage the finish as it rests on the door 12.

A pulley set support bracket 60 of the upper member 14 is attached to each arm 50 and includes a generally u-shaped body 62 that fits around the arm 50. A lip 64 extends downwardly from the body 62, and a ledge 66 extends from the lip 64 away from the body 62. Support bracket 60 includes a locking arm 68 having a hook portion 70 for engaging the positioning slots 56 of the arm 50 so as to maintain a position of the support bracket 60 along the arm 50. Locking arm 68, as shown, can pivot about an axle 72 in order that the hook portion 70 may be moved into and out of locking engagement with the positioning slots 56. Thus, the locking arms 68 and the positioning slots 56 provide for the adjustable positioning of the support brackets 60 along the arms 50 so that the distance of the support brackets 60 from the top surface 24 of the door 12 can be adjusted.

Pivot pins 80 are connected with the ledge 66 of the support bracket 60. As shown each pivot pin 80 has a generally circular cross section shape and extends between a base 82 and a tip 84, with the base 82 generally near the ledge 66 and the pivot pin 80 extending upwardly therefrom so the tip 84 is above the base 82. Of course, other shapes are also possible for the pivot pins 80, such as those having different cross sectional shapes.

According to certain embodiments of the invention, the pivot pins 80 also include one or more retainer members for holding a pulley member selectively captive on the pivot pin. As used herein, the term "selectively captive" refers to the condition where a pulley member is retained on a pivot pin in a manner appropriate for using the fitness device, but also where the pulley member can be removed from the pivot pin by a user without the need for tools separate from the fitness device. Thus, while the retainer members are configured to hold the pulley members selectively captive on the pivot pins, they are also configured to allow a user to relatively easily remove and install the pulley members on the pivot pins.

In the embodiment shown in FIGS. 1-4, these retainer members are in the form of nubs 86 that extend radially from an outer wall 88 of each pivot pin 80 in a region generally near the tip 84. As shown, the nubs 86 are disposed on opposite sides of the circumference of the pivot pin 80 and have a generally circular cross section shape. For example, the nubs 86 could be formed by a cylindrical rod that extends through the pivot pin 80. Of course, it will be appreciated that other configurations and shapes for the nubs 86 are also possible. For example, there could be only one nub 86, or more than two nubs 86. The nubs 86 could also have different shapes other than a generally circular cross section.

With reference to FIGS. 1, 2A, and 2B, features of the lower member 16 are described. The lower member 16 includes two generally similar door anchors 100 for connecting with the door 12. In particular, each door anchor 100 includes a first, generally vertical, portion 102 and second, generally horizontal, portion 104. The second portion 104 extends under the bottom surface 28 of the door 12, and the first portion 102 extends upwardly from the second portion 104 along the back side 22 of the door 12. Pads, although not shown, can be included on the first and second portions 102, 104 so that the door anchor 100 does not damage the finish as it rests on the door 12. The second portion 104 extends beyond the front side 20 of the door 12, and a pulley support bracket 110 of the lower member 14 is attached thereto in the region of the bottom rail portion 30. The support bracket 110 includes a first leg 112 that extends from the second portion 104 upwardly and away from the front side 20 of the door 12. A second leg 114 extends from the first leg 112 upwardly and back toward the front side 20 of the door 12. A foot portion 116 extends upwardly from the second leg 114 generally near the front side 20 of the door 12. A pad 46 can be provided on the foot portion 116 so that the bracket 110 does not damage the finish as it rests on the door 12. A ledge 118 extends from the second leg 114, such as in a generally perpendicular direction, intermediate the first leg 112 and the foot portion 116 and away from the front side 20 of the door 12. The ledge 118 is disposed at an angle from the bottom surface 28 of the door 12.

Pivot pins 120 are connected with the ledge 118 of the support bracket 110. As shown each pivot pin 120 has a generally circular cross section shape and extends between a base 122 and a tip 124, with the base 122 generally near the ledge 118. The pivot pin 120 extends downwardly from the base 122 and away from the front side 20 of the door 12 so the tip 124 is below the base 122. Of course, other shapes are also possible for the pivot pins 120, such as those having different cross sectional shapes.

Like the pivot pins 80, and according to certain embodiments of the invention, the pivot pins 120 also include one or more retainer members for holding a pulley member selectively captive on the pivot pin. In the embodiment shown in FIGS. 1-4, these retainer members are in the form of nubs 126 that extend radially from an outer wall 128 of the pivot pins 120 in a region generally near the tip 124. As shown, the nubs 126 are disposed on opposite sides of the circumference of the pivot pin 120 and have a generally circular cross section shape, but it will be appreciated that other configurations and shapes are also possible. For example, the nubs 126 could be formed by a cylindrical rod that extends through the pivot pin 120. Of course, it will be appreciated that other configurations and shapes for the nubs 126 are also possible. For example, there could be only one nub 126, or more than two nubs 126. The nubs 126 could also have different shapes other than a generally circular cross section.

Each of the resilient cords 18*a*-18*f* is associated with a pair of substantially similar pulley members 140*a*-*f* and 140*a*'-140*f*', respectively. For example, the resilient cord 18*a* is associated with pulley members 140*a* and 140*a*', with pulley member 140*a* being associated with the upper member 14 and pulley member 140*a*' being associated with the lower member 16. As will be explained more fully below, the pulley members 140*a*-*f* and 140*a*'-*f*' are easily installed on and removed from the upper and lower members 14, 16, as shown in FIGS. 2A and 2B.

Because the pulley members 140*a*-140*f* and 140*a*'-140*f*' are substantially similar, features of a single pulley member 140*a* will be described. In addition, because the installation of the pulley members 140*a*-140*f* is substantially similar for the upper and lower members 14, 16, reference will be made to the interaction of the features of the upper member 14 with the pulley member 140*a*.

Pulley member 140*a* includes a body 142 having a mounting portion 144 and a pulley portion 146. The mounting portion 144 includes a bore 148 configured to receive a pivot pin 80. As shown, the bore 148 is a through bore having a shape that generally corresponds with the shape of the pivot pin 80. To that end, the bore 148 includes keyways 150 for receiving the nubs 86 on the pivot pin 80. In particular, the keyways extend along substantially the entire length of the bore 148, and have a shape that corresponds with the nubs 86. Particularly, the keyways 150 include a three-sided trough extending from the bore 148 into the body 142 in order to generally correspond with and accommodate the shape of the nubs 86. Given this configuration, the installation and removal of the pulley member 140*a* from the pivot pin 80 is limited to when the keyways 150 of the bore 148 are aligned with the nubs 86 of the pivot pin 80. Near the mounting portion 144, the body 142 includes an upper surface 152, a lower surface 154, side surfaces 156, 158, a front surface 160, and a back surface 162.

The pulley portion 146 of the pulley member 140*a* extends from the mounting portion 144 and includes fingers 170 having a proximal portion 172 near the mounting portion 144 and a distal portion 174 away from the mounting portion 144. A wheel space 176 is defined between the fingers 170 near the distal portion 174, and a wheel 178 is mounted on an axle 180 in the wheel space 176. As shown, the wheel 178 includes a groove 182 between two flanges 184 in order to guide the elastic cord 18*a* as it travels around the wheel 178.

Figure 3A:
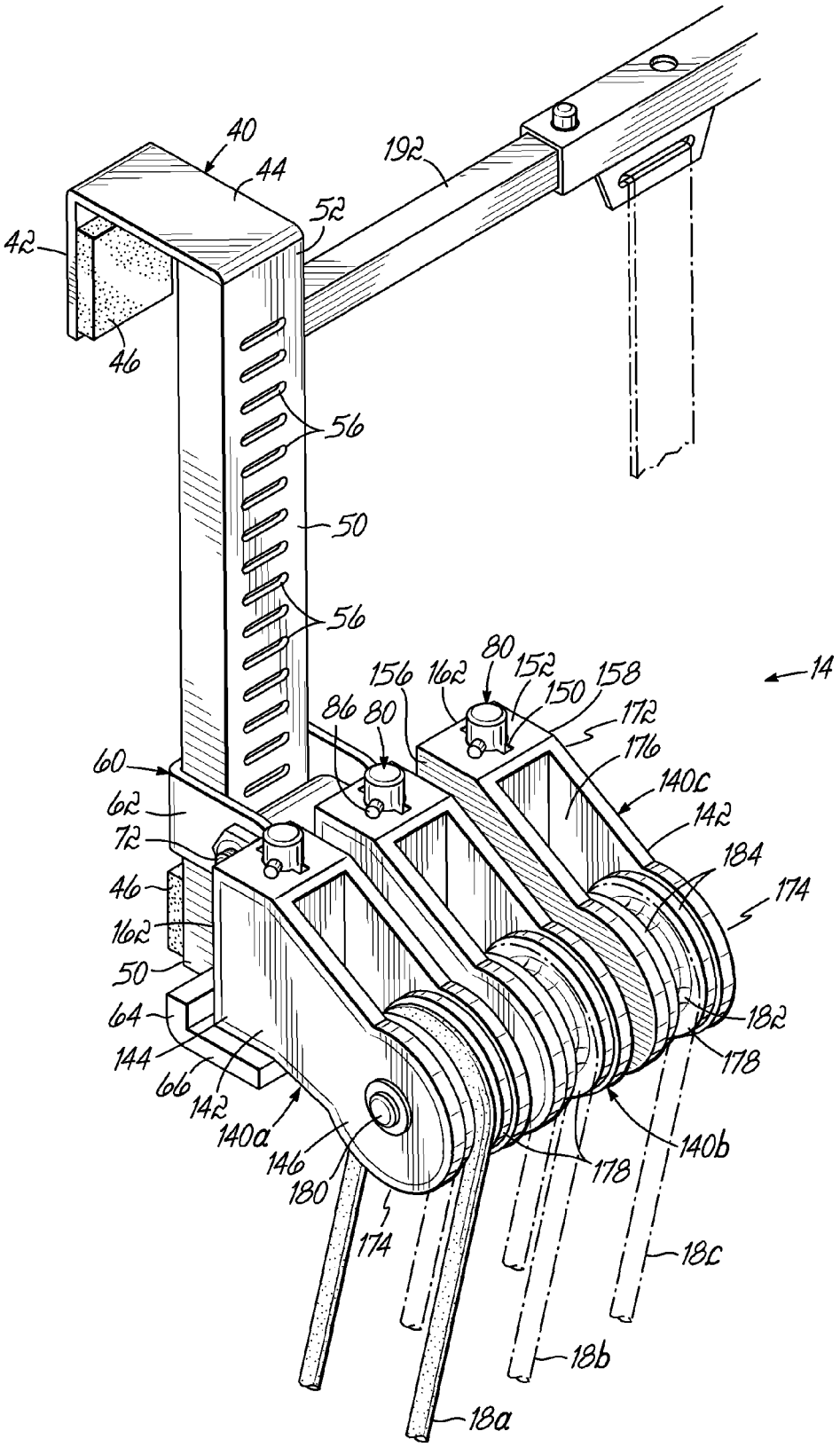
FIG. 3A is an isometric view depicting portions of the upper member, with three pulley members positioned on pivot pins.
Figure 3B:
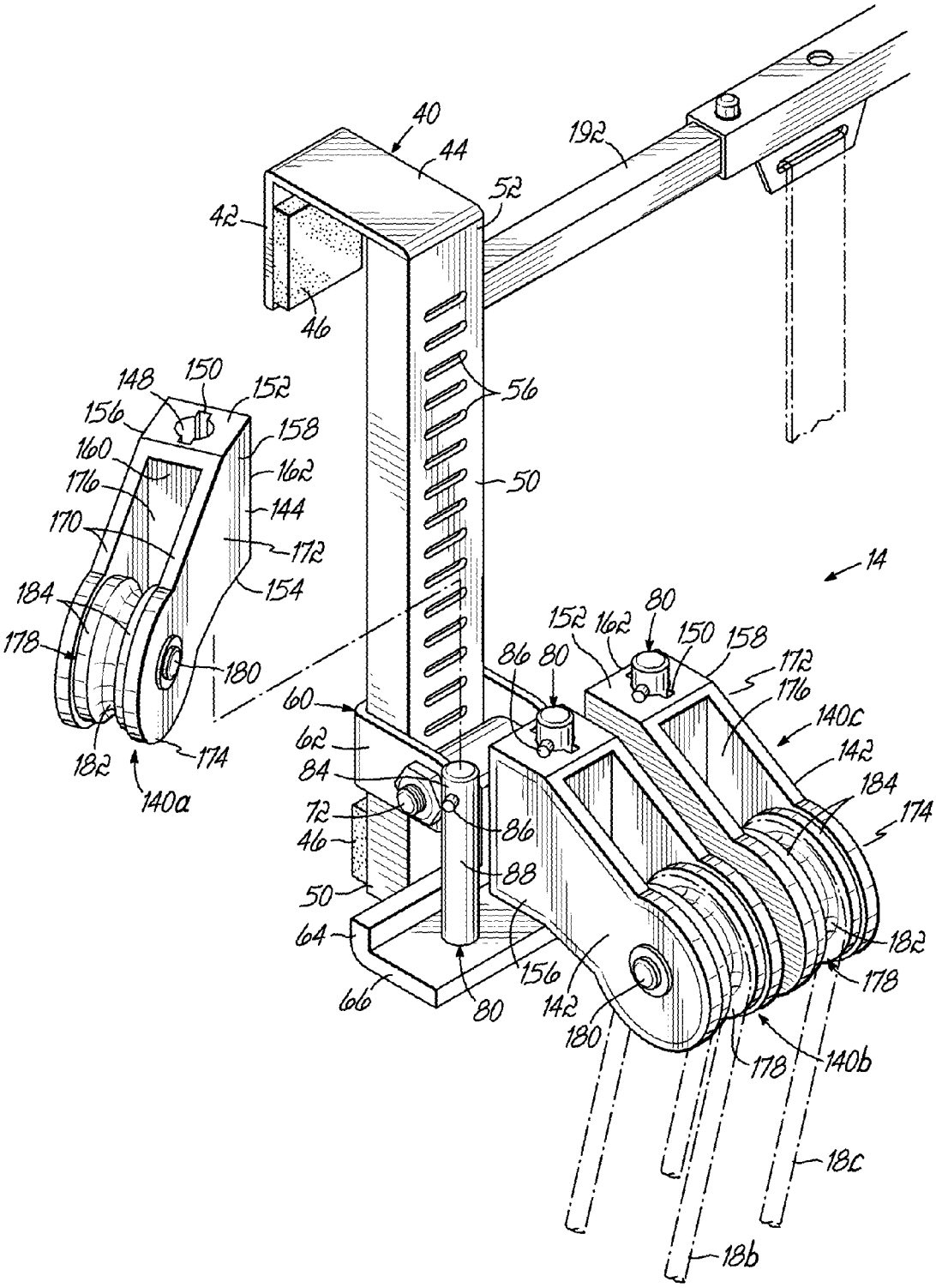
FIG. 3B is a view like in FIG. 3A, but with one of the pulley members removed from the pivot pin, and with the elastic cord removed for clarity.
Figure 4:
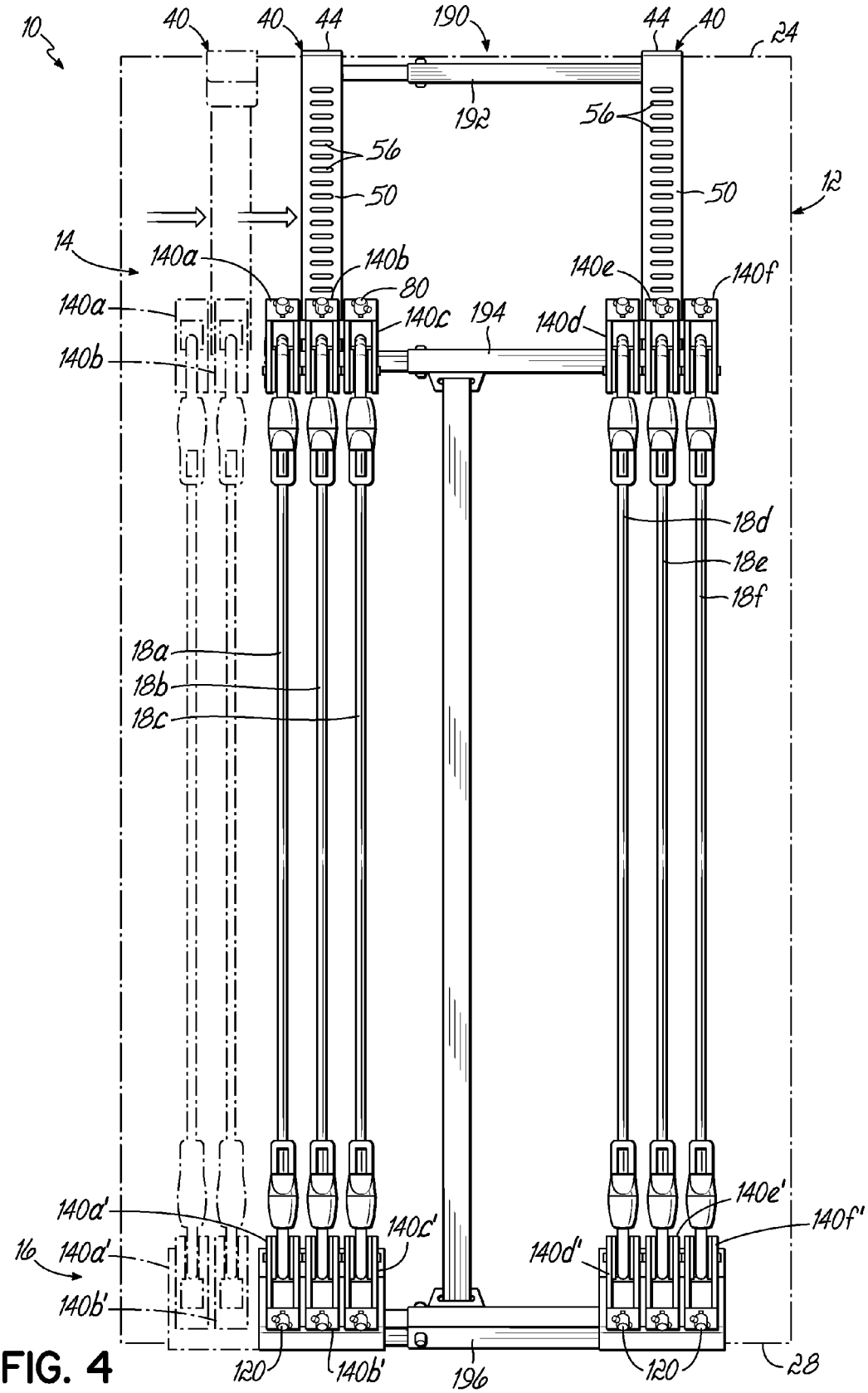
FIG. 4 is a front elevation view like in FIG. 1, and showing widthwise adjustment of the door-mounted fitness device.

With reference to FIGS. 3A and 3B, the installation and removal of the pulley member 140*a* from the pivot pin 80 of the upper member 14 is now described. First, with reference to FIG. 3B, the pulley member 140*a* is placed slightly above the left-most pivot pin 80 so the bore 148 is generally above and aligned with the pivot pin 80. The pulley member 140*a* is rotated so the keyways 150 in the bore 148 are aligned with the nubs 86 on the pivot pin 80. The pulley member 140*a* is then lowered down onto the pivot pin 80, so that as the tip 84 of the pivot pin 80 enters the bore 148, the nubs 86 are received in the keyways 150. With the pivot pin 80 in the bore 148 and the nubs in the keyways 150, the pulley member 140*a* is lowered completely onto the pivot pin 80 so that the lower surface 154 thereof rests on the ledge 66 of the support bracket 60. In such a position, the nubs 86 of the pivot pin 80 extend slightly above, or clear, the upper surface 152 of the pulley member 140. Thus, the mounting portion 144 is positioned generally between the ledge 66 of the support bracket 60 and the nubs 86 of the pivot pin 80. The pulley member 140*a* is then rotated so the keyways 150 in the bore 148 no longer align with the nubs 86 of the pivot pin 80. Thereby, the pulley member 140*a* is free to pivot on the pivot pin 80, but is held selectively captive by the nubs 86. In particular, unless the keyways 150 are aligned with the nubs 86, the pulley member 140*a* cannot be removed from the pivot pin 80 because the nubs 86 will contact the upper surface 152. Generally, the position of the pivot pins 80 along the support bracket 60 is chosen so that the side and back surfaces 156, 158, 162 of adjacent pulley members 140 do not interfere with each other during normal use conditions, such as when the pulley members 140 pivot on the pivot pins 80 during exercise movements.

Removal of the pulley member 140*a* from the pivot pin follows similar principles as disclosed above for installation. In particular, the pulley member 140*a* is pivoted on the pivot pin 80 until the nubs 86 are aligned with the keyways 150 in the bore 148 of the pulley member 140*a*. Then, the pulley member 140*a* may be moved away from the ledge 66 of the support bracket 60, with the nubs 86 being received in the keyways 150, until the pulley member 140*a* is completely removed from the pivot pin 80.

Because of their similarity, all of the pulley members 140*a*-140*f* and 140*a*'-140*f*' are installed and removed from the respective pivot pins 80 or 120 in a manner similar to what is described above.

Figure 5:
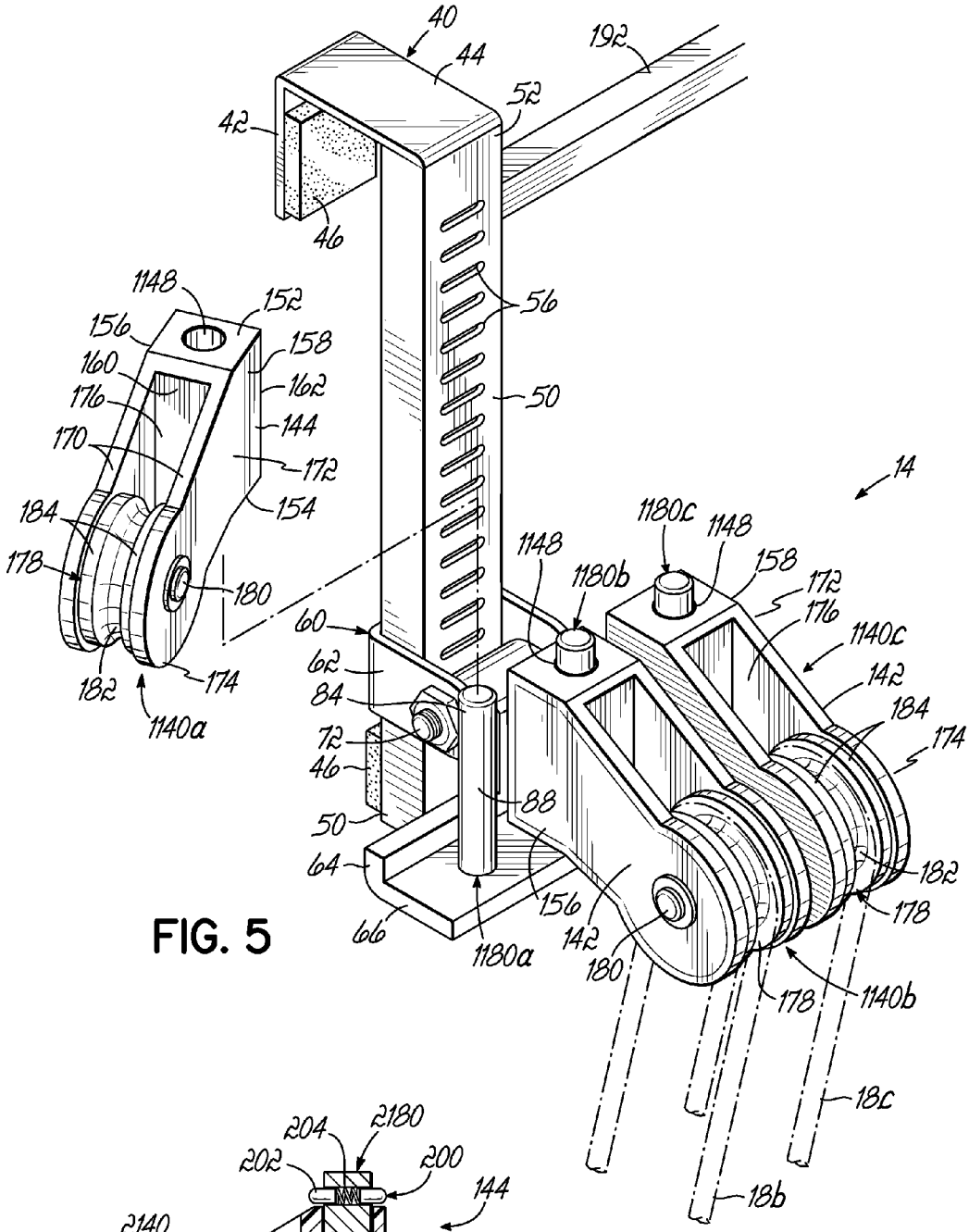
FIG. 5 is a view like FIG. 3B, but showing pulley members and pivot pins according to a further embodiment of the present invention.
Figure 6:
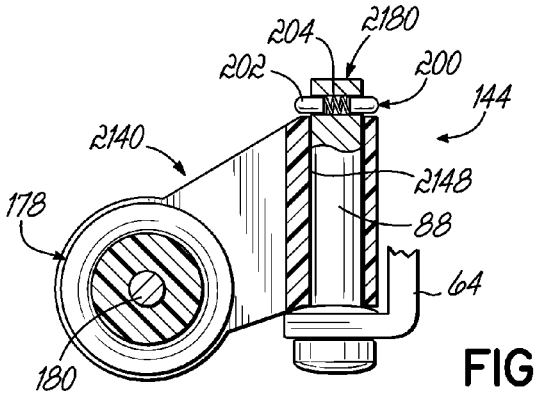
FIG. 6 is a side view in partial cross section showing a pulley member and pivot pin according to an even further embodiment of the present invention.

Turning next to FIGS. 5 and 6, additional pulley member and pivot pin arrangements are shown which may be used in accordance with further embodiments of the invention. In FIG. 5, an arrangement is shown where the pivot pins do not include a retaining member, and in FIG. 6, an arrangement is shown having a spring loaded detent assembly retaining member. In FIGS. 5 and 6, elements that have the same configuration as what is shown and discussed with respect to FIGS. 1-4 have the same reference numbers, while elements having a different configuration have new and different reference numbers.

As shown in FIG. 5, there are similar pulley members 1140*a*, 1140*b*, 1140*c* associated with similar respective pivot pins 1180*a*, 1180*b*, and 1180*c*. Since pulley member 1140*a* is exemplary of the other pulley members, and since pivot pin 1180*a* is exemplary of the other pivot pins, only the pulley member 1140*a* and pivot pin 1180*a* are described. Pulley member 1140*a*, which is shown removed from its pivot pin 1180*a*, includes a mounting portion 144 having a bore 1148. Bore 1148 is internally smooth and has a generally circular cross sectional shape. Bore 1148 does not include keyways like the bore 148 discussed above. The associated pivot pin 1180*a*, in turn, has a generally cylindrical shape and does not include any retaining members extending from its outer wall 88. The pivot pin 1180*a* does not include nubs 86 like the pivot pin 80 discussed above. The bore 1148 and pivot pin 1180*a* are configured to have generally corresponding shapes. In a fitness device using pulley members and pivot pins such as pulley member 1140*a* and pivot pin 1180*a*, there is no retaining member on the pivot pin for holding a pulley member selectively captive on the pivot pin. Instead, the tension exerted on the pulley members 1140 (a, b, c, etc.) by the elastic cords 18 (a, b, c, etc.) between the upper and lower members 14, 16 holds the pulley members selectively captive. That is, the pulley members 1140 on the upper member 14 are held on their associated pivot pins 1180 (a, b, c, etc.) by the generally downwardly-directed force created by tension in the associated elastic cords 18. Similarly, the pulley members on the lower member are held on their associated pivot pins by the generally upwardly-directed force created by tension in the associated elastic cords 18. The tension force created by the elastic cords 18 is easily overcome by a user, however, and the arrangement shown in FIG. 5 still allows a user to relatively easily remove and install the pulley members 1140 onto the pivot pins 1180. Thus, in such an arrangement, the pulley members are held selectively captive on their respective pivot pins only by the tension force created by the elastic cords.

As shown in FIG. 6, a pulley member 2140 is associated with and positioned on a pivot pin 2180. Of course, several pulley members and pivot pins similar to pulley member 2140 and pivot pin 2180 could be used in a fitness device. Pulley member 2140 includes a mounting portion 144 having a bore 2148, which is generally internally smooth and has a generally circular cross sectional shape. Bore 2148 does not include keyways like the bore 148 discussed above. The associated pivot pin 2180, in turn, has a generally cylindrical shape and includes retaining members in the form of a spring loaded detent assembly 200. The spring loaded detent assembly 200 includes fingers 202 which protrude from opposite sides of the circumference of the pivot pin 2180 and which are outwardly biased by a centrally disposed spring 204. The fingers 202 are moveable generally completely within the outer wall 88 of the pivot pin 2180, but are biased by the spring 204 to protrude beyond the outer wall 88. The pulley member 2140 is installed onto the pivot pin 2180 by pressing the fingers 202 into the pivot pin 2180 and then sliding the bore 2148 onto the pivot pin 2180. The fingers 202 can be pressed into the pivot pin 2180 manually by a user or by the interaction of the fingers 202 and the pulley member 2140 as the pulley member 2140 is slid onto the bore 2148. Once the pulley member 2140 is completely on the bore 2148, the fingers 202 extend beyond the outer wall 88 of the pivot pin 2180 (as shown in FIG. 6), thereby holding the pulley member 2140 selectively captive on the pivot pin 2180. The pulley member 2140 is removed in a similar manner as it is installed. The fingers 202 are pressed into the pivot pin (either manually by a user or by the interaction of the fingers 202 and the pulley member 2140), and the pulley member 2140 can then be removed from the pivot pin 2180.

Advantageously, a user can benefit from pulley members being easily installed onto and removed from a fitness device, as disclosed herein. For example, a set of elastic cords can be supplied that provide a range of resistances, with each elastic cord being associated with pulley members constructed according to the present invention. If a user desires one or more elastic cords having heavy resistance, the same can be easily installed onto the device. If it becomes necessary to remove elastic cords and pulley members from the device before installing desired elastic cords, the removal is also easily accomplished. Advantageously, the ability to use a wide range of elastic cords with the device increases the number of users who could receive its benefits, including those desiring either high resistance or low resistance. And, because of the configuration of the pivot pins (including their nubs) and the bores in the pulley members (including their keyways), the pulley members are held selectively captive on the pivot pins during normal use and are only removed when the nubs and keyways are aligned, which typically occurs only with deliberate manipulation. Further, all of the elastic cords can be removed from the device for easy installation, storage, and transport. For example, the upper member can be installed onto a door and adjustments made thereto without the user having to contend with elastic cords and the lower member being attached. In addition, the upper member, lower member, and elastic cords/pulley members can be stored separately, improving packaging and transport. For example, a user could easily package the various components of the device in a bag and take them with him for exercise away from home, such as in a hotel. Upon arriving at the hotel, the components are easily assembled into an operable fitness device, and one that provides a desired amount of resistance as chosen by the user.

In addition, the device 10 includes a lateral connector assembly 190 that provides for widthwise adjustment of the components. Lateral connector assembly 190 includes a first portion 192 connecting the door anchors 40 of the upper member 14, a second portion 194 connecting the support brackets 60 of the upper member 14, and a third portion 196 connecting the support brackets 110 of the lower member 16. Each of the first, second, and third portions 192, 194, 196 may include a telescoping tubular arrangement, so that a first tube portion thereof is slidably received within a second tube portion thereof. In addition, any or all of the first, second, and third portions 192, 194, 196 may include a locking pin, such as a spring loaded pin, to selectively fix the position of the respective first and second tube portions.

Fitness devices constructed according to the concepts disclosed herein provide several advantages over prior art forms. For example, a fitness device is provided that can be mounted on a door and is useful for performing resistance exercises. In addition, because pulley members can be easily installed onto and removed from the fitness device, a user can choose an elastic cord of his choosing. This is an improvement over devices that provide pre-installed elastic cords that do not provide a desired amount of resistance and do not allow the user to easily replace or modify the elastic cords. In addition, the components of the fitness device can be separated, which improves installation, storage, and transport.

While the present invention has been illustrated by a description of particular embodiments thereof and specific examples, and while the embodiments have been described in some detail, they are not intended to restrict or in any way limit the scope of the appended claims to such detail. Additional advantages and modifications will readily appear to those skilled in the art. For example, while in some embodiments, each pivot pin includes two nubs and each bore includes two keyways, other numbers of nubs and keyways could also be used, such as matching numbers of nubs and keyways. Additionally, the shape configuration of the nubs and keyways could be modified in any suitable way. Further, while in some embodiments each pivot pin includes two fingers in a spring loaded detent assembly, other numbers of fingers could also be used. Also, while each pulley support bracket shown in the figures includes three pivot pins and supports three pulley members, different numbers of pivot pins and pulley members could be provided on each support bracket. Further, while in certain embodiments the pulley members include a through bore, a blind bore could also be used. For example, a blind bore could include keyways for receiving nubs therein, and could include an annular channel in the body of the pulley member at a desired position along the bore. Once the nubs reached the annular channel, the pulley member could pivot on the pivot pin with the nubs travelling in the annular channel. The pulley member would thus be held selectively captive on the pivot pin until the nubs and keyways were again aligned.

The invention in its broader aspects is therefore not limited to the specific details, representative apparatus and illustrative examples shown and described. Accordingly, departures may be made from such details without departing from the scope or spirit of the general inventive concept.

The invention claimed is:

1. A fitness device for mounting on a door and being useful for performing resistance exercises, comprising:

an upper member including a door anchor for securing the upper member to the door, and a first pulley support bracket having a first pivot pin coupled thereto;

a lower member including a door anchor for securing the lower member to the door, and a second pulley support bracket having a second pivot pin coupled thereto; and an elastic cord configured to extend generally between the upper and lower members and being associated with first and second pulley members, the first pulley member being configured to be held selectively captive on the first pivot pin, and the second pulley member being configured to be held selectively captive on the second pivot pin, the first pivot pin having a first retaining member extending radially outward therefrom, and the second pivot pin having a second retaining member extending radially outward therefrom, and the first and second retaining members being configured to hold the respective first and second pulley members selectively captive on the respective first and second pivot pins such that the first and second pulley members may be received on and removed from the respective first and second pivot pins while the first and second pivot pins remain coupled to the respective first and second pulley support brackets.

2. The fitness device of claim 1, the first pulley member including a first bore and the second pulley member including a second bore, the first and second bores configured to receive the respective first and second pivot pins.

3. The fitness device of claim 2, wherein the first and second retaining members include nubs, and the first and second bores of the first and second pulley members include keyways configured to receive the nubs.

4. The fitness device of claim 3, wherein the keyways must be aligned with the nubs for the first and second pulley members to be received on or removed from the respective first and second pivot pins.

5. The fitness device of claim 3, wherein the first and second pivot pins and the first and second bores have generally circular cross-sectional shapes.

6. The fitness device of claim 3, the first and second bores being through bores.

7. The fitness device of claim 3, the nubs being positioned to clear an upper surface of the first and second pulley members when the first and second pulley members are completely received on the first and second pivot pins.

8. The fitness device of claim 3, at least one of the first or second pulley members resting on the respective at least one of the first or second pulley support brackets when the at least one of the first or second pulley members is completely received on the respective at least one of the first or second pivot pins.

9. The fitness device of claim 1, wherein at least one of the first or second retaining members includes a spring loaded detent assembly assemblies.

10. The fitness device of claim 9, wherein the spring loaded detent assembly includes at least one finger moveable generally completely within an outer wall of the respective at least one of the first or second pivot pins.

11. The fitness device of claim 10, the at least one finger extending beyond the outer wall when the respective at least one of the first or second pulley members is completely received on the respective at least one of the first or second pivot pins.

12. The fitness device of claim 1, wherein at least one of the first or second retaining members includes a pair of diametrically opposed projections.

* * * * *